US011849830B2

(12) United States Patent
Howell

(10) Patent No.: US 11,849,830 B2
(45) Date of Patent: Dec. 26, 2023

(54) COMPOUND ARC PACK AND FRAME

(71) Applicant: Down East Innovation, LLC, Bridgton, ME (US)

(72) Inventor: Frank A. Howell, Sweden, ME (US)

( * ) Notice: Subject to any disclaimer, the term of this patent is extended or adjusted under 35 U.S.C. 154(b) by 0 days.

(21) Appl. No.: 17/537,632

(22) Filed: Nov. 30, 2021

(65) Prior Publication Data

US 2022/0167730 A1 Jun. 2, 2022

Related U.S. Application Data

(60) Provisional application No. 63/120,377, filed on Dec. 2, 2020.

(51) Int. Cl.
*A45F 3/08* (2006.01)
*A45F 3/04* (2006.01)

(52) U.S. Cl.
CPC ..... *A45F 3/08* (2013.01); *A45F 3/047* (2013.01)

(58) Field of Classification Search
CPC ..... A45F 2003/045; A45F 3/04; A45F 3/047; A45F 3/08; A45F 3/10
USPC ..... 224/153
See application file for complete search history.

(56) References Cited

U.S. PATENT DOCUMENTS

| | | | | |
|---|---|---|---|---|
| 2,421,244 A | | 10/1943 | Diaber | |
| 4,356,942 A | | 11/1982 | Hays | |
| 4,878,606 A | * | 11/1989 | Miller | A45F 5/00 224/625 |
| 4,911,346 A | | 3/1990 | Shallman | |
| 5,503,314 A | | 4/1996 | Fiscus | |
| 5,553,759 A | * | 9/1996 | McMaster | A45F 3/08 224/264 |
| 6,892,915 B2 | * | 5/2005 | Mares | A45F 3/20 224/630 |
| 7,644,847 B2 | * | 1/2010 | Howell | A45F 3/08 224/628 |
| 7,793,809 B2 | * | 9/2010 | Howell | A45F 3/10 224/628 |
| 8,556,147 B2 | | 10/2013 | Howell | |
| 11,311,062 B2 | * | 4/2022 | Roque | A41D 13/0562 |
| 2006/0163305 A1 | | 7/2006 | Tong | |

FOREIGN PATENT DOCUMENTS

| | | | |
|---|---|---|---|
| EP | 0567173 A1 | | 10/1993 |
| FR | 3028734 A1 | * | 5/2016 |

OTHER PUBLICATIONS

FR-3028734-A1 Translation, Moulin J, May 2016 (Year: 2016).*

* cited by examiner

*Primary Examiner* — Nathan J Newhouse
*Assistant Examiner* — Matthew T Theis
(74) *Attorney, Agent, or Firm* — Gesmer Updegrove LLP

(57) ABSTRACT

A novel backpack frame and backpack are described where the frame has a common point from which a pair of upper vertical support members ascend and a pair of lower vertical support members descend. The lower vertical support members are mirror images of each other and one lower vertical support member has a twist in a first direction to form a latitudinal concavity relative to the back side of the backpack and another lower vertical support member has another twist in a second direction to form another longitudinal concavity relative to the backpack back side, where the second direction is opposite to the first direction.

20 Claims, 14 Drawing Sheets

FIG. 1D
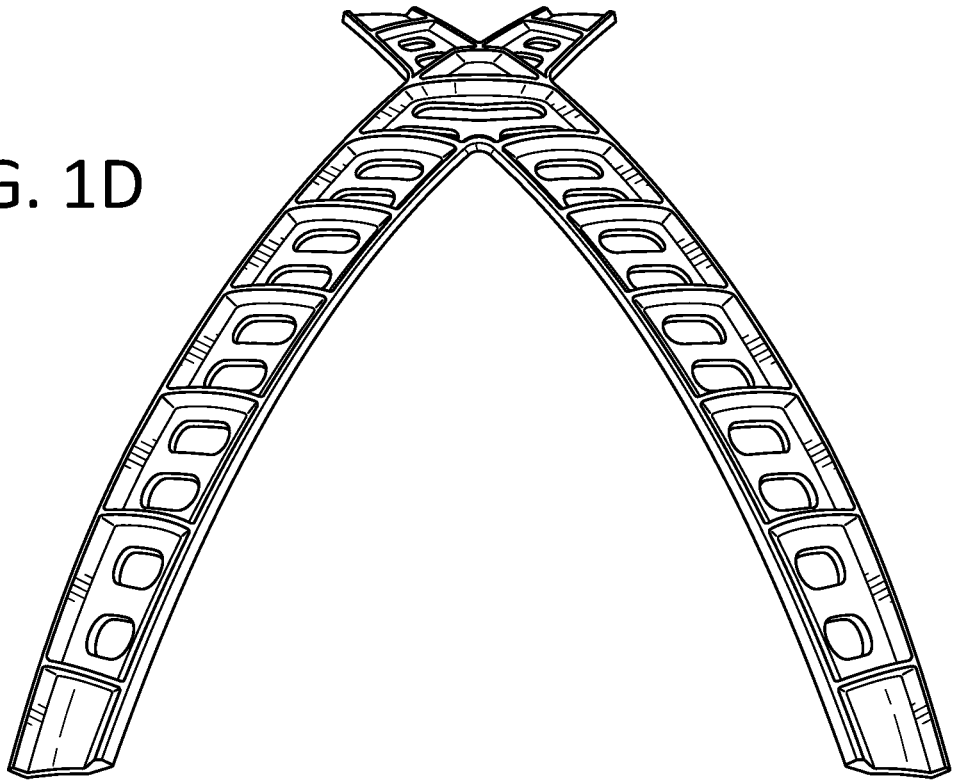
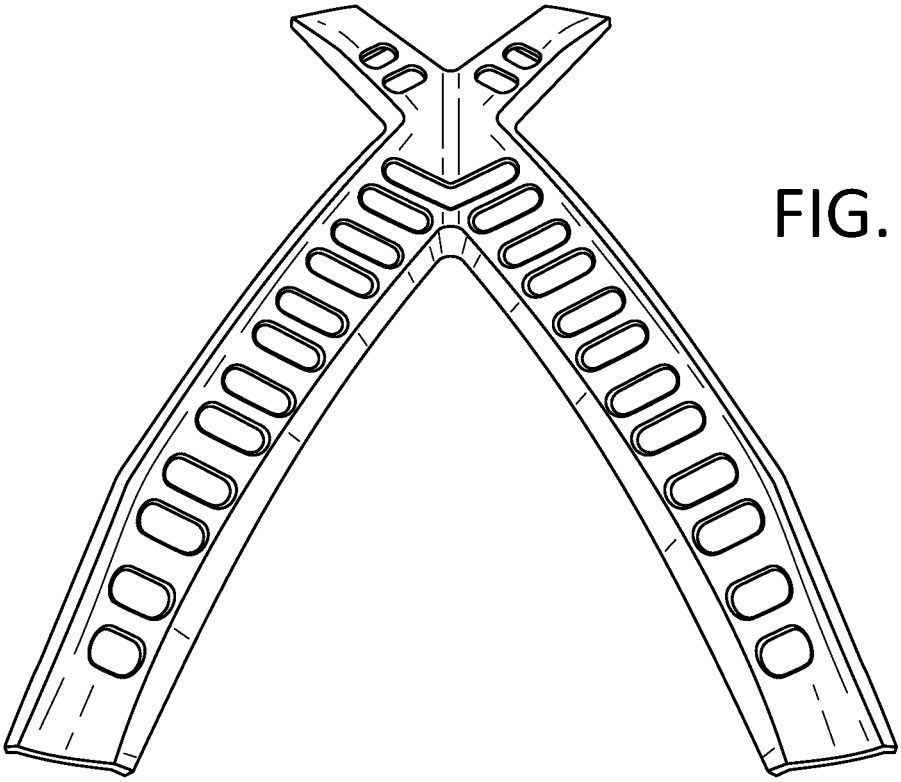
FIG. 1E

COMPOUND ARC PACK AND FRAME

RELATED APPLICATION

This application claims the benefit of provisional application 63/120,377 filed Dec. 2, 2020.

BACKGROUND OF THE INVENTION

Field of Invention

The present invention relates generally to backpacks intended to carry heavy loads and more specifically to those of lesser volumes.

Discussion of Prior Art

Operational considerations on the modern battlefield now require combatants to carry a wide variety of gear. In addition to ancient fundamentals such as water, weapons, ammunition, entrenching tools and the like, combatants now must carry heavy, dense items such as powerful batteries, sophisticated radios, computers, drones, optics and more. These items must be readily accessible, protected from damage, all while being carried in the most efficient manner possible to minimize fatigue.

Prior art backpacks used for this purpose are primarily known as "patrol nicks". The civilian analog for this is the "bookbag" used for school trips, day hiking and the like.

The patrol nick typically consists of relatively small fabric enclosure with two shoulder straps and possibly a light weight waistbelt attached. The panel adjacent to the wearer's back is often reinforced with a plastic or foam sheet to guard against carried objects protruding uncomfortably.

The legacy patrol nick, while adequate for carrying socks, rations, and other personal items, does not adequately support, protect, and stabilize the plethora of modern equipment essential for survival on the modern battlefield.

These new items, even while occupying little space, present a serious challenge to the patrol nick wearer: loads sag and slosh about, thus concentrating pressure uncomfortably while confounding balance during vigorous moments. This tendency is further aggravated by the wearing of body armor; its hard, convex surface imparts little to no stabilizing influence on the patrol nick.

Whatever the precise merits, features, and advantages of the above cited references, none of them achieves or fulfills the purposes of the present invention.

SUMMARY OF THE INVENTION

In one embodiment, the present invention provides a backpack frame for use with a backpack, the backpack frame having a backpack frame front side, a backpack frame back side and a central axis, the backpack having a backpack back side that retains the backpack frame, the backpack frame comprising: (a) a common point; (b) a first upper vertical support member and a second upper vertical support member, the first and second upper vertical support members ascending from the common point, wherein the first and second upper vertical support members are mirrored images of each other and are separated from each other equidistantly with respect to the central axis; (c) a first lower vertical support member descending from the common point and longitudinally concave relative to the backpack back side; (d) a second lower vertical support member also descending from the common point and also longitudinally concave relative to the backpack back side, and wherein the first lower vertical support member and the second lower vertical support member are mirror images of each other and are separated from each other equidistantly with respect to the central axis, and wherein the first lower vertical support member having a twist in a first direction to form a latitudinal concavity relative to the backpack back side and the second lower vertical support member having another twist or a cant in a second direction to form another longitudinal concavity relative to the backpack back side, the second direction opposite to the first direction.

In another embodiment, the present invention provide an apparatus comprising: (a) a backpack having a backpack back side and a backpack front side, the backpack back side having a pair of lower receiving pockets disposed at a bottom side of the backpack back side and a pair of upper receiving pockets disposed at a top side of the backpack back side; (b) a backpack frame for use with the backpack, the backpack frame having a backpack frame front side, a backpack frame back side and a central axis, the backpack back side retaining the backpack frame, the backpack frame comprising: (1) a common point; (2) a first upper vertical support member and a second upper vertical support member, the first and second upper vertical support members ascending from the common point, wherein the first and second upper vertical support members are mirrored images of each other and are separated from each other equidistantly with respect to the central axis; (3) a first lower vertical support member having a first lower vertical support member free end, the first lower vertical support member descending from the common point and longitudinally concave relative to the backpack back side, the first lower vertical support member free end configured to rest in one of the lower receiving pockets; (4) a second lower vertical support member having a second lower vertical support member free end, the second lower vertical support member also descending from the common point and also longitudinally concave relative to the backpack back side, the second lower vertical support member free end configured to rest in another one of the lower receiving pockets, and wherein the first lower vertical support member and second lower support member are mirror images of each other and are separated from each other equidistantly with respect to the central axis, and wherein the first lower vertical support member having a twist in a first direction to form a latitudinal concavity relative to the backpack back side and the second lower vertical support member having another twist or a cant in a second direction to form another longitudinal concavity relative to the backpack back side, the second direction opposite to the first direction.

BRIEF DESCRIPTION OF THE DRAWINGS

The present disclosure, in accordance with one or more various examples, is described in detail with reference to the following figures. The drawings are provided for purposes of illustration only and merely depict examples of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

FIGS. 1A-E depict various perspectives of the present invention's articulating frame.

DESCRIPTION OF THE PREFERRED EMBODIMENTS

Figure 1A:
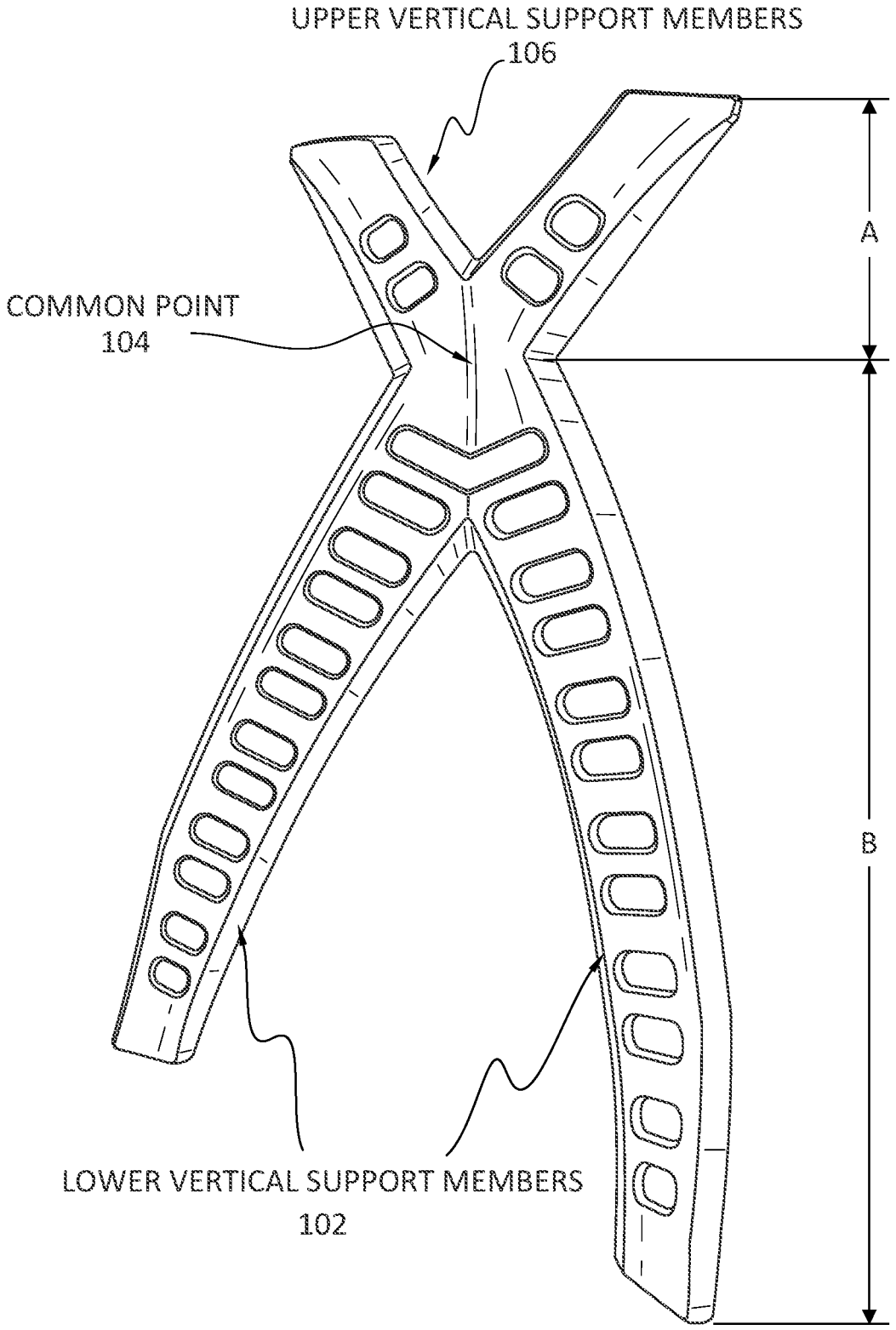

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Figure 1B:
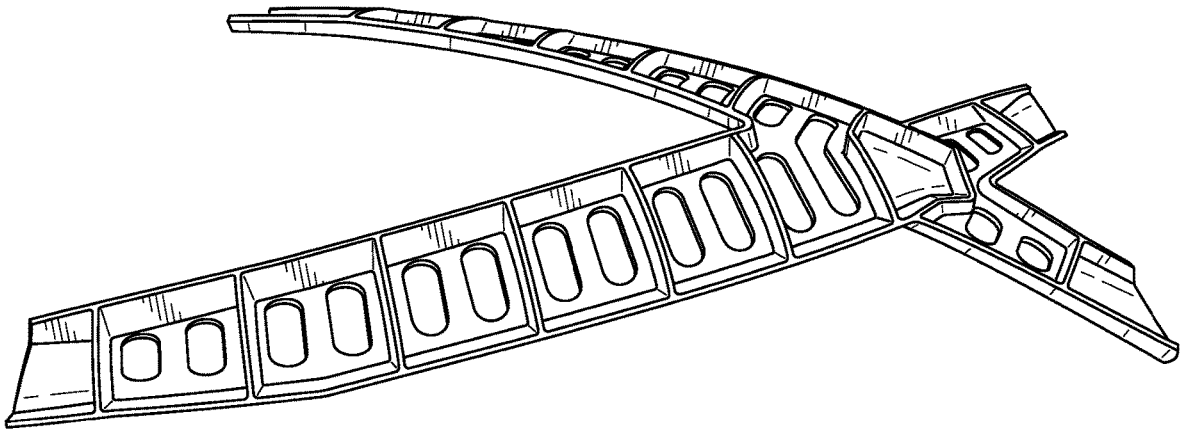
Figure 1C:
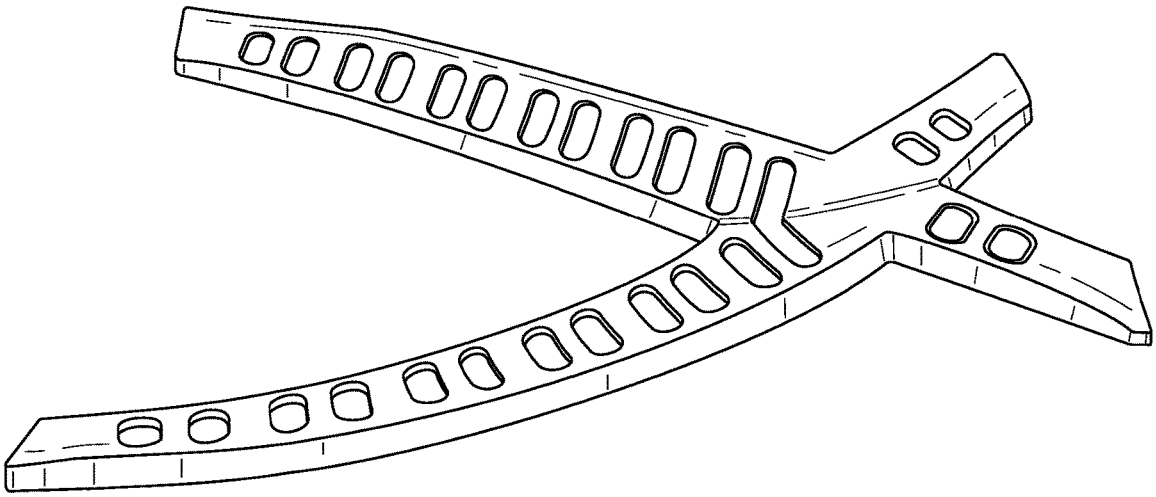

FIG. 1A depicts the present invention's frame which solves the prior art's shortcomings by carrying the equipment while supporting, protecting, and optimizing comfort. The present invention's articulating frame whose arcing and diverging lower vertical support members 102 project from a common point 104 at or near the top of the nick. The present invention's frame also has a pair of upper vertical support members 106 ascending from the common point. Additionally, because the vertical support members of the frame extend downward from and diverge from the common point, they can freely and independently flex fore and aft to accommodate the wearer's torso twist while walking. The present invention's compound arc frame's common point provides the primary structural base to receive and distribute the ruck's load to the vertical support members while allowing them to freely and independently flex fore and aft to accommodate the wearer's torso twisting while walking. FIGS. 1B (rear rotated view), 1C (front rotated view), 1D (rear view), and 1E (front view) depict various other perspectives of the present invention's frame. In one non-limiting example, the frame may be made from injection molded thermoplastics. However, other materials such as carbon-fiber composites, wood, or any material with the ability to flex without damage may be used and such materials are considered within the scope of the invention.

Common point 104 could be located anywhere between the top and middle of the frame to achieve some benefit. In the preferred embodiment, a center of the common point 104 is located approximately 20% (of the overall frame length) below the frame top. In one non-limiting example, it is envisioned that the center of the common point may be located between 5% to 30% below the frame top.

In one embodiment, the ratio of A/B in FIG. 1A is 1:4 based on the 20% (measured from the top) example noted above.

In one non-limiting example, A=3.5" with B=14" but it should be noted that the specific dimensions may be sized up or down to best accommodate various body sizes.

Figure 2A:
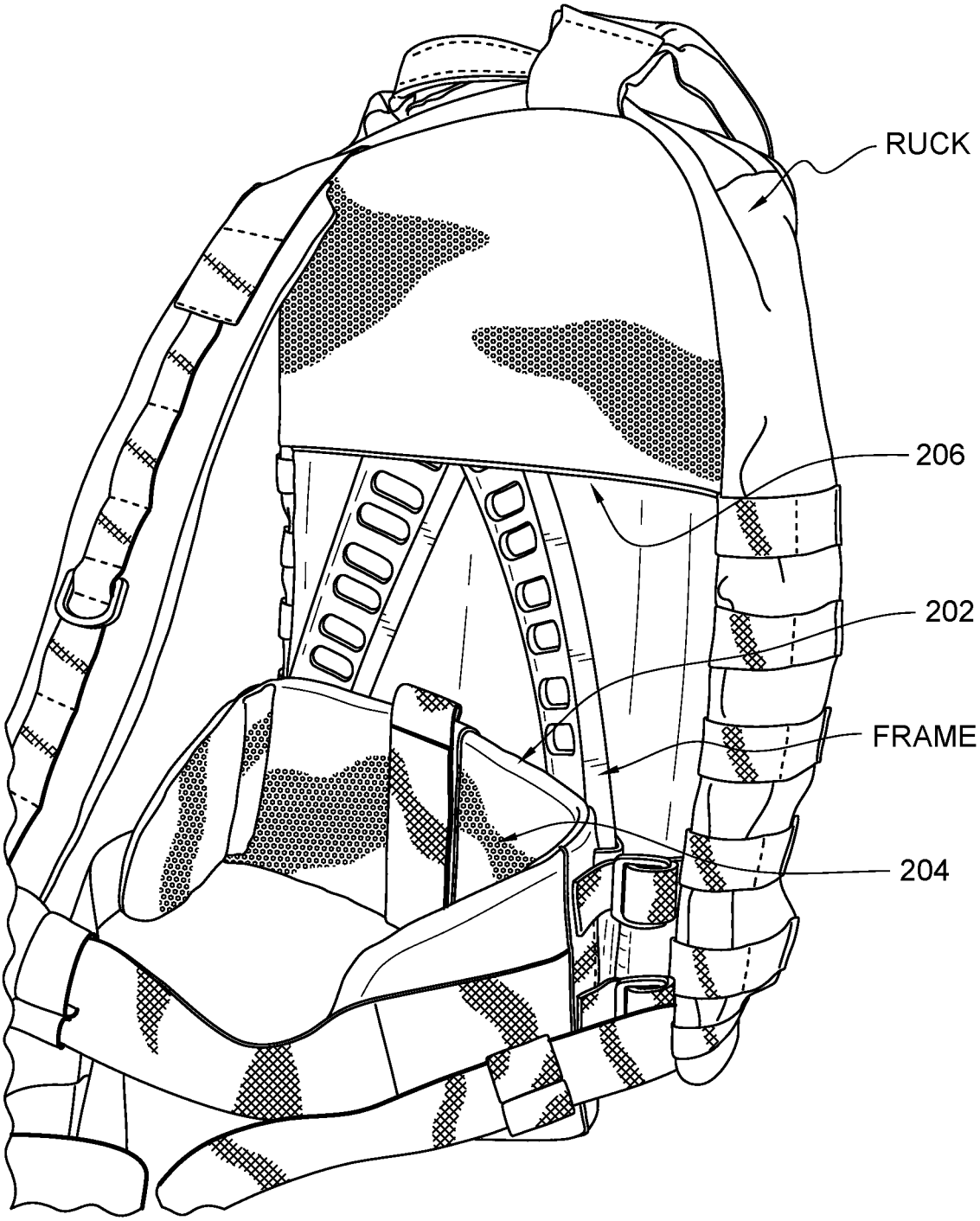
FIGS. 2A-B depict another embodiment of the present invention, wherein the present invention provides both a frame (of FIGS. 1A-F) and a ruck which retains the frame on the backside.
Figure 2B:
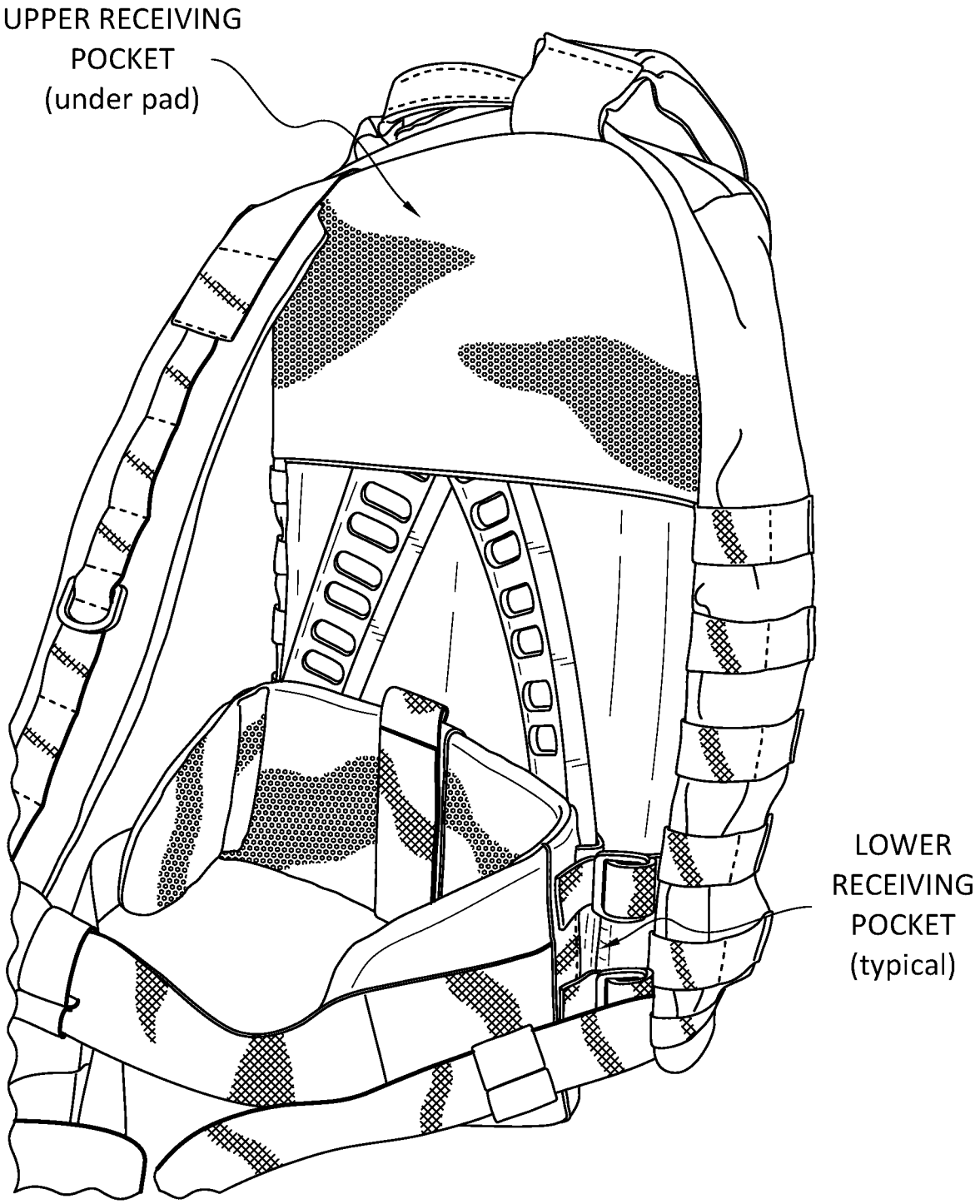

FIGS. 2A-B depict another embodiment of the present invention, wherein the present invention provides both a frame (as described above) and a ruck which retains the frame on the backside. In this embodiment, the frame is stabilized by lower receiving pockets 202 on or near the nick's waistbelt 204 and an upper receiving pocket 206 at or near the top of the nick. The present invention's compound arc ruck's upper and lower receiving pockets capture, and control loads imparted by the frame. The upper receiving pocket is integral to the ruck's top while the lower receiving pockets can be integrated into either a detachable waistbelt or at the bottom of the ruck's back panel. In one non-limiting example, the pockets are made of fabric and/or foam sheets folded and sewn.

The top of the frame slides into engagement with the ruck's upper pocket(s) from below and is held in position by the three sides of the pocket(s), and vertically, by vertically tensioning the back panel (the same, or adjacent panel as the upper pockets) of the ruck against the waist belt. Please note that the frame does not have to have two crenelations at the top (as shown); this structure can be solid or even be a grab-handle that slides into a single receiving pocket or even loops made from webbing on the ruck's back-panel. The lower frame members slide into receiving pockets integrated into the belt. These are also made of sewn fabric and/or foam panels or could be web-loops.

Figure 3:
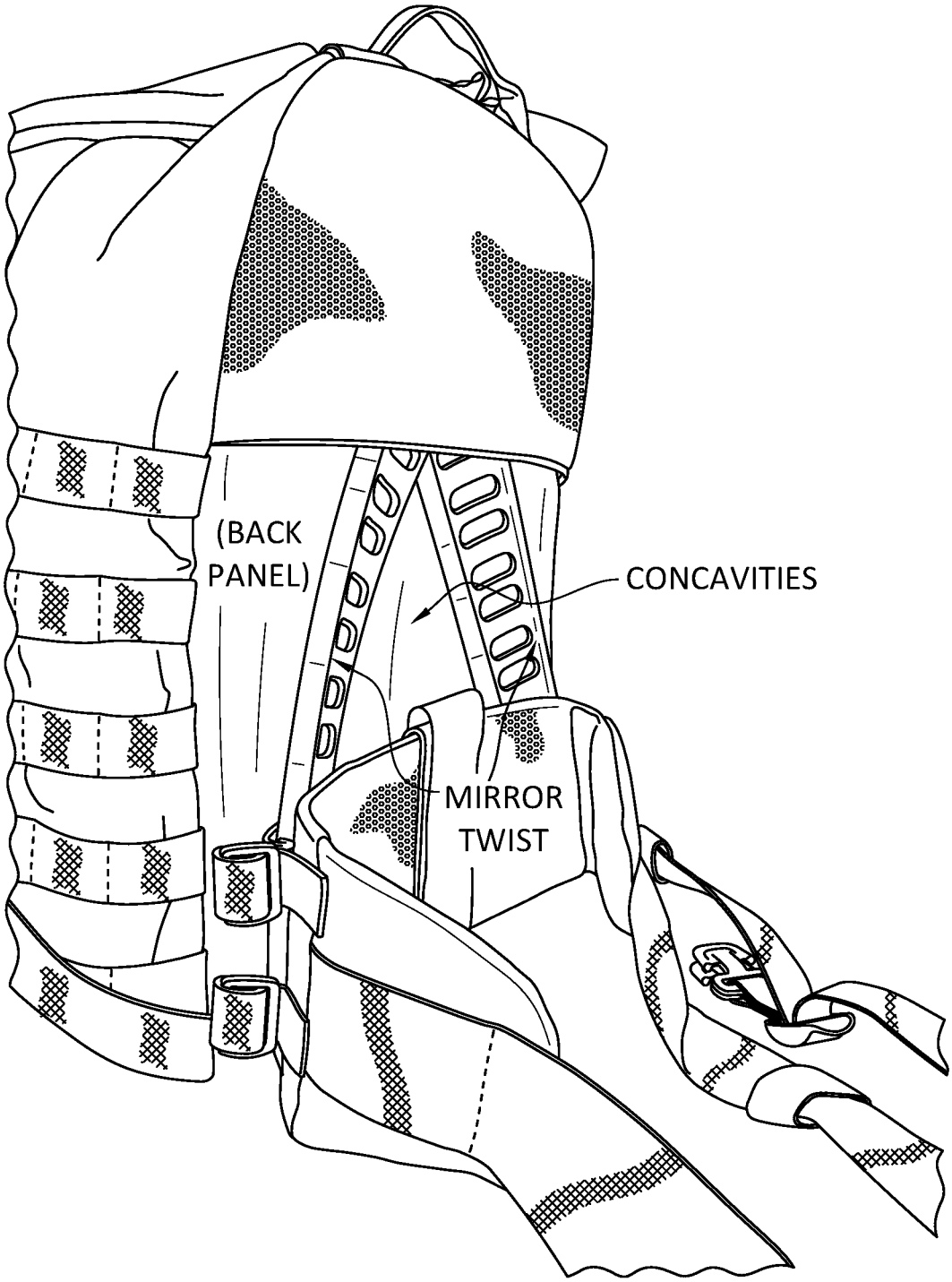
FIG. 3 depicts an angled side-view of the frame with the ruck.

FIG. 3 depicts an angled side-view of the frame with the ruck. In the preferred embodiment, the vertical support members are longitudinally concave relative to the wearer's back and are formed by both curving and a twist progressing downward from the common point at or near the top of the ruck. Additionally, the vertical support members are mirror images of each other, rotated to further form a latitudinal concavity relative to the wearer's back. The two vertical members descend independently from the common point at or near the top of the frame, wherein these vertical members effectively transfer carried load from the common point downward and outward to the wearer's iliac area and away from the more pressure sensitive sacrum.

The twisted vertical members are mirror images of each other, i.e., twist in opposite directions as they descend from the common point toward their distal ends. This twist encourages each member to flex outward (away) from the frame's vertical center line when loaded; this tendency is resisted by the ruck's back panel and/or waistbelt, thereby imparting stability to the structure while permitting inward flex to facilitate cinching the nick around the wearer's body. Additionally, the mirror image twists contribute to the creation of the frame's concavity relative to the wearer's back.

The compound arc frame's longitudinal curve of the vertical support members is concave relative to the wearer's back to create space there and enhance the structure's ability to resist load induced peeling away from the wearer's back while bowing sympathetically to cushion vertical impact loads imparted by walking. As employed here, the opposite "twist" of each leg forces the lower legs to try to split apart when a carried load tries to peel the frame away from the wearer's back; the pocket and belt arrangement constrains the distal ends of the lower legs from separating longitudinally, thus mechanically stabilizing the structure. As depicted in the figures, these legs are only slightly opposing spirals; primarily, they are longitudinally and continuously "canted" approximately 15 degrees (5-45 degrees being the useful range) throughout their length. A structural stiffening/bracing effect is accomplished because the canted, proximal ends of the legs blend into the common point's formed concavity (which is already at a mechanically useful angle) instead of originating from different, separate points.

Constrained by the upper and lower receiving pockets at the nick's top and bottom, the two vertical Support members stabilize each other latitudinally as their mirror image twists strain against each other through the nick's back panel and waistbelt. Yet, the wearer can still cinch the nick's shoulder straps and waistbelt to pull the nick into closer proximity to the wearer's back for improved stability and center of gravity. This is also facilitated by the mirror image twists of the frame's vertical support members and the flexible nature of the nick's back panel; both can flex inward around the wearer's back as needed.

The longitudinal curve of the vertical support members co-acting with the nick through the upper and lower receiving pockets further enhance the structure's ability to resist load induced peeling away from the wearer's back while bowing sympathetically to cushion vertical impact loads imparted by walking.

The belt and frame assembly can attach to the nick by the belt, or the frame, or both. Attaching the belt directly to the frame allows for rapid and convenient detachment of the belt and frame assembly from the nick for times when use of the ruck without both the belt and frame is desired. Attaching the ruck directly to the frame, and the belt directly to the frame improves the stability of both components since both the ruck and the belt are directly benefiting from the stabilizing influence of the frame. The preferred ruck embodiment allows for the operator to choose either configuration based on mission considerations.

Figure 5A:
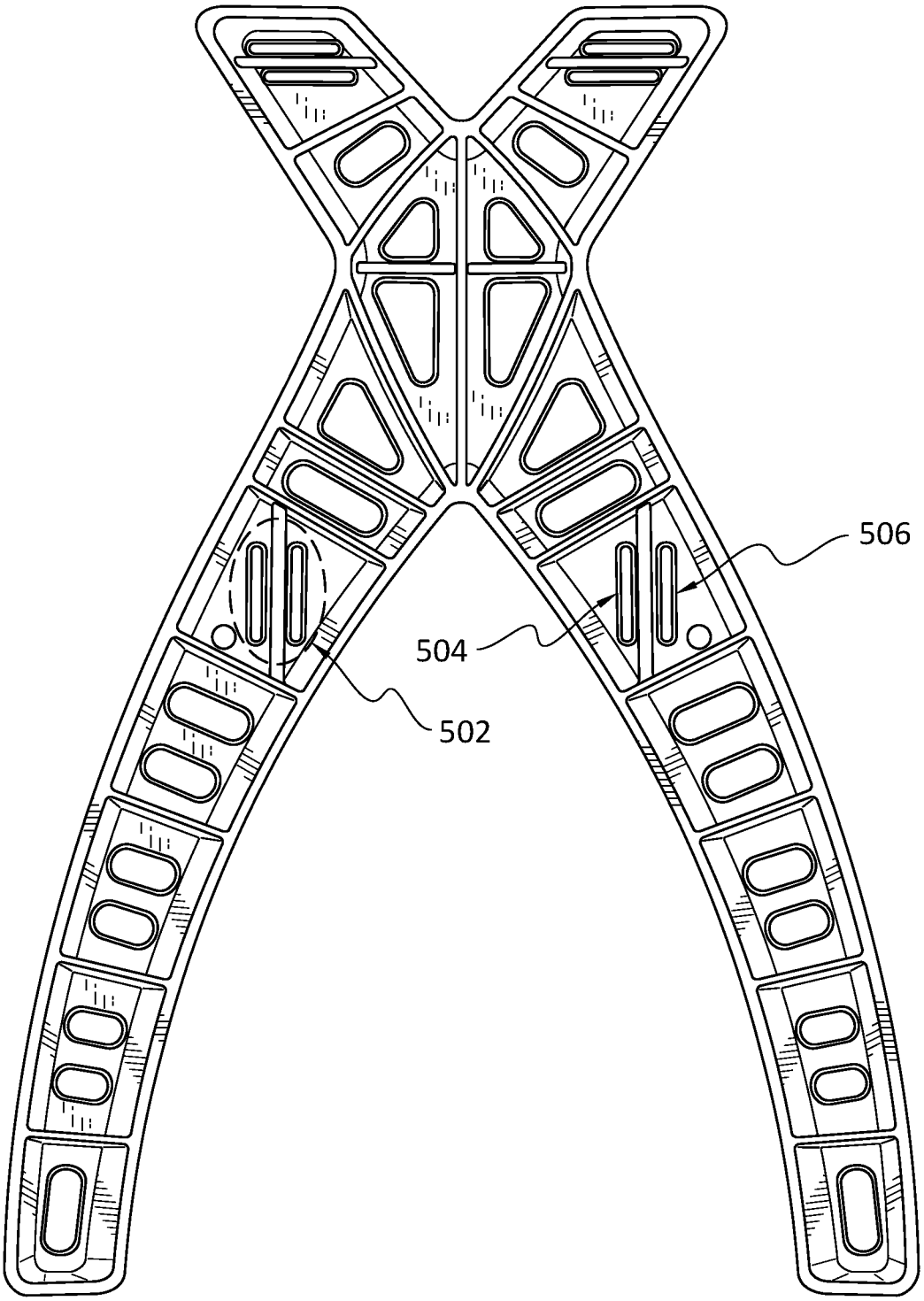
FIG. 5A depicts a rear view of the present invention's frame showing four scapula slots.

FIG. 5A depicts a rear view of the present invention's frame showing a pair of scapula slots 502 disposed on each of the vertical support members. Each pair of scapula slots includes a left vertical slot 504 and a right vertical slot 506. In one embodiment, scapula pad attachment webs are sewn to the back panel and threaded through the frame's upper and lower scapula slots and are tensioned to further anchor and stabilize the ruck on the frame. The scapula slots are provided in a vertical orientation to better stabilize the shoulder pad attachment and integrate the encircling ruck compression strap. An orientation other than the vertical orientation, it was found that the frame's common point is on the centerline and does not impart the desired longitudinal stability to the ruck's back panel unless both are very securely joined. Additionally, grabbing and lifting the loaded ruck by a shoulder strap pulls the pads directly out and away from the frame unless they are securely anchored together. Accordingly, integrating the compression strap longitudinally at this location further enhances the stability of carried loads.

Figure 5B:
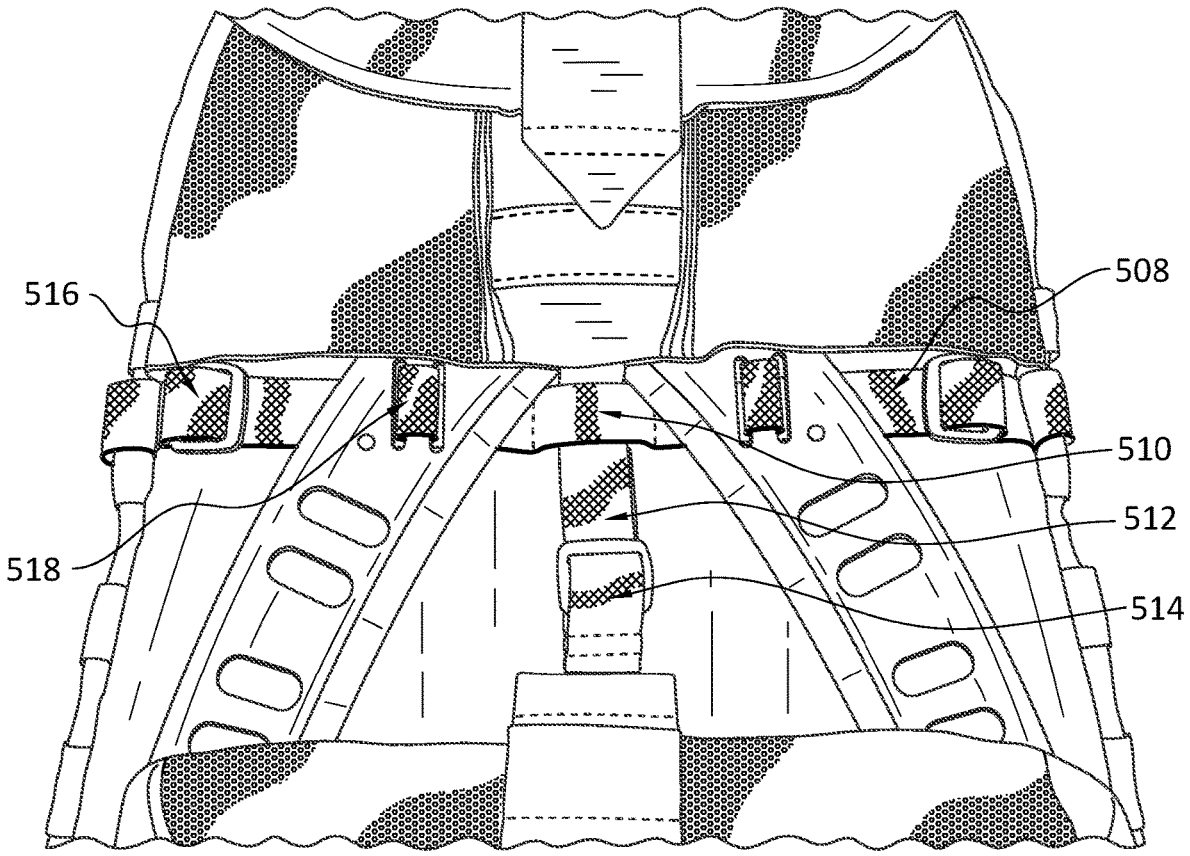
FIG. 5B depicts a horizontal mount strap that spans the entire width of ruck's back panel with a horizontal adjuster (s) at each end to allow the horizontal mount strap to thread through the scapula slots.
Figure 5C:
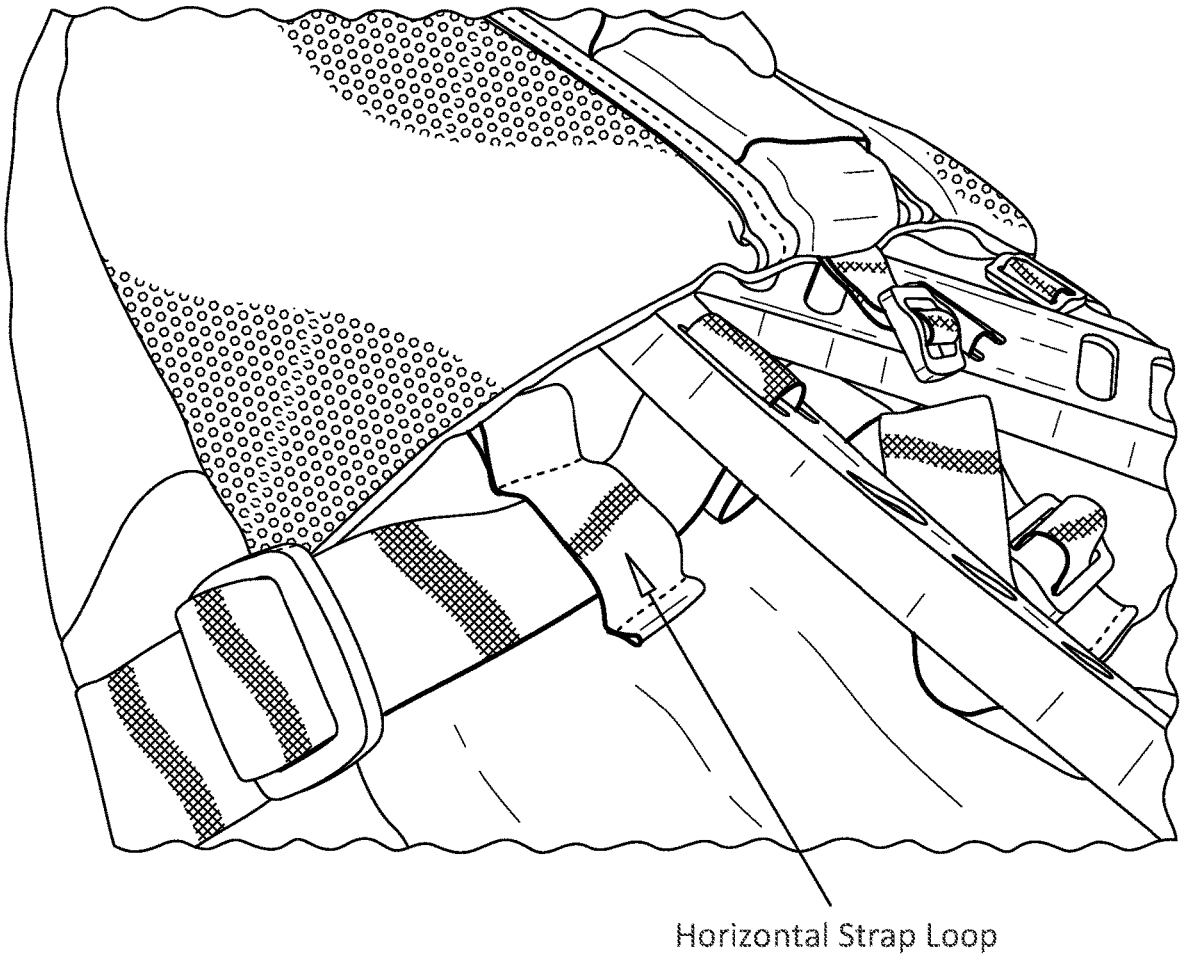
FIG. 5C depicts a horizontal strap loop (one on either side) of the present invention.
Figure 5D:
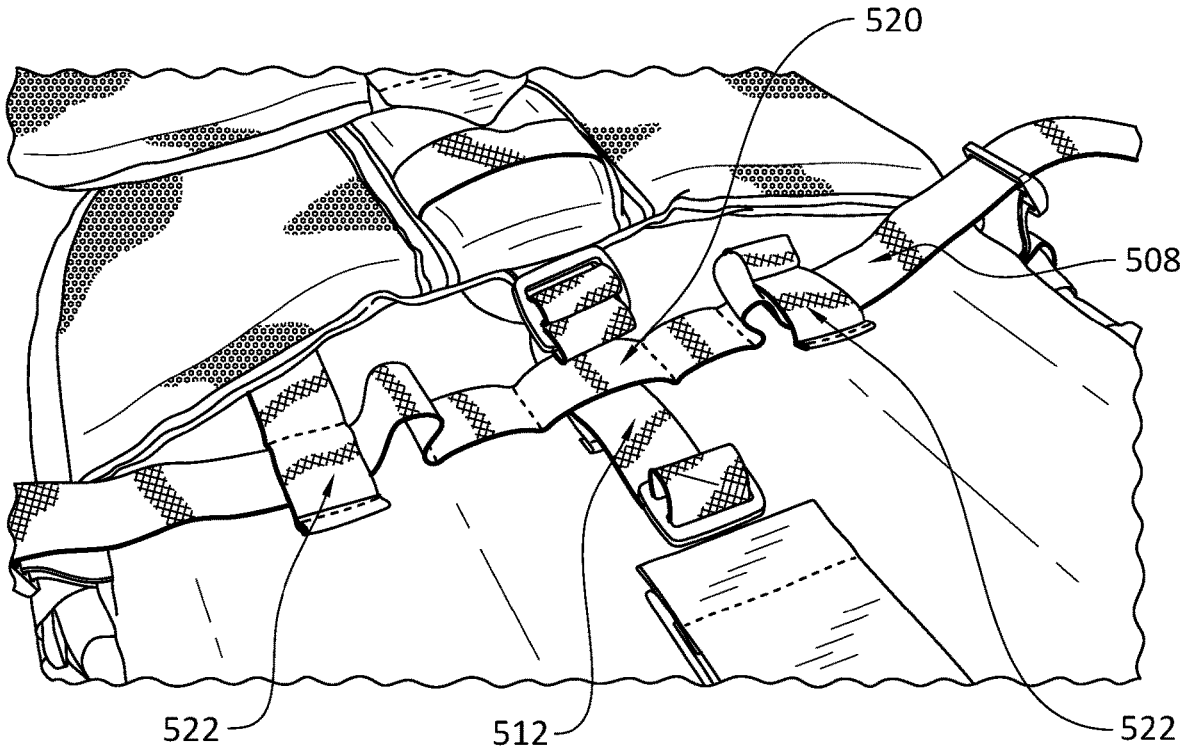
FIG. 5D depicts the arrangement of FIG. 5B without the frame in place.
Figure 5E:
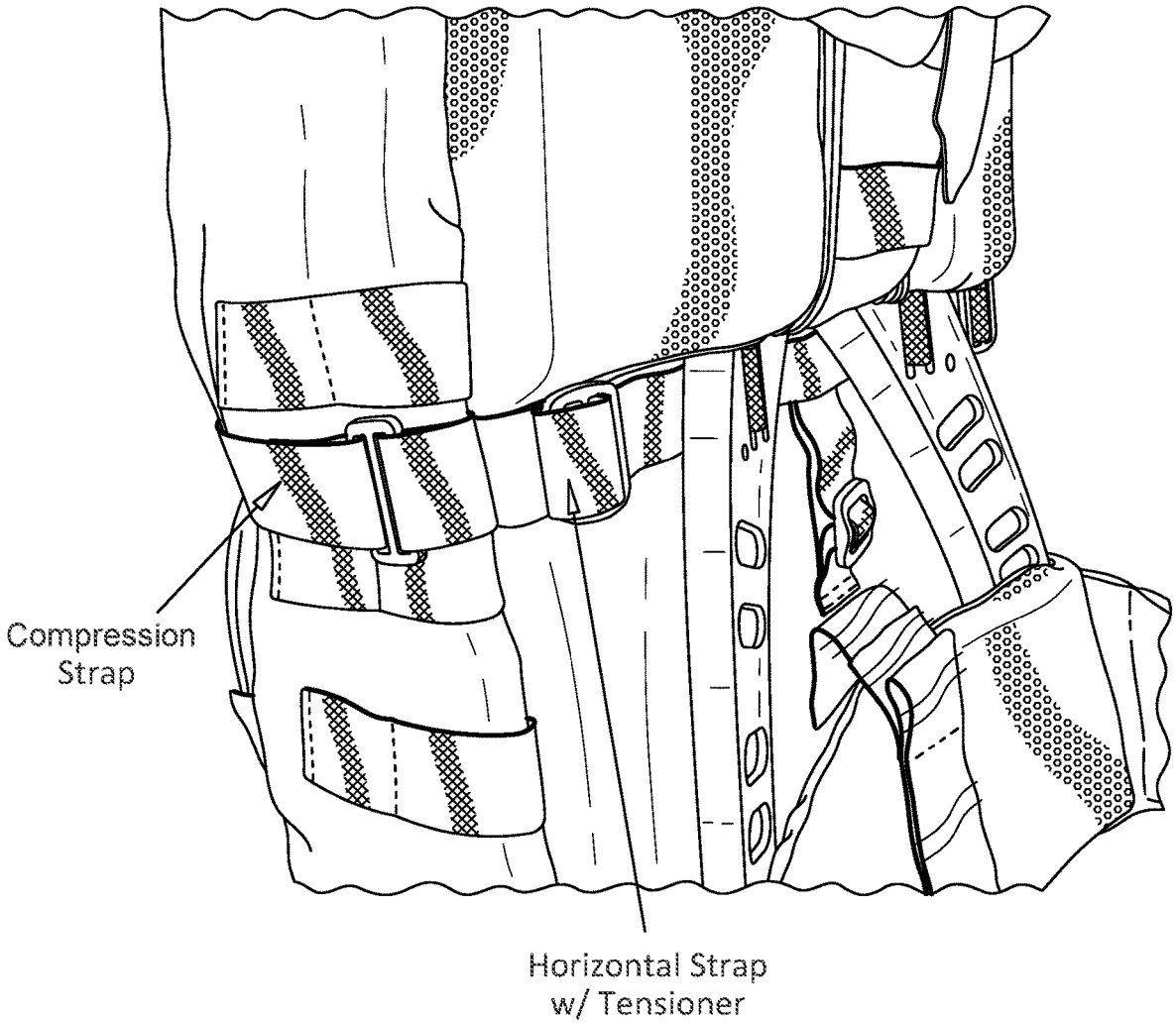
FIGS. 5E and 5F detail the compression strap's preferred embodiment.
Figure 5F:
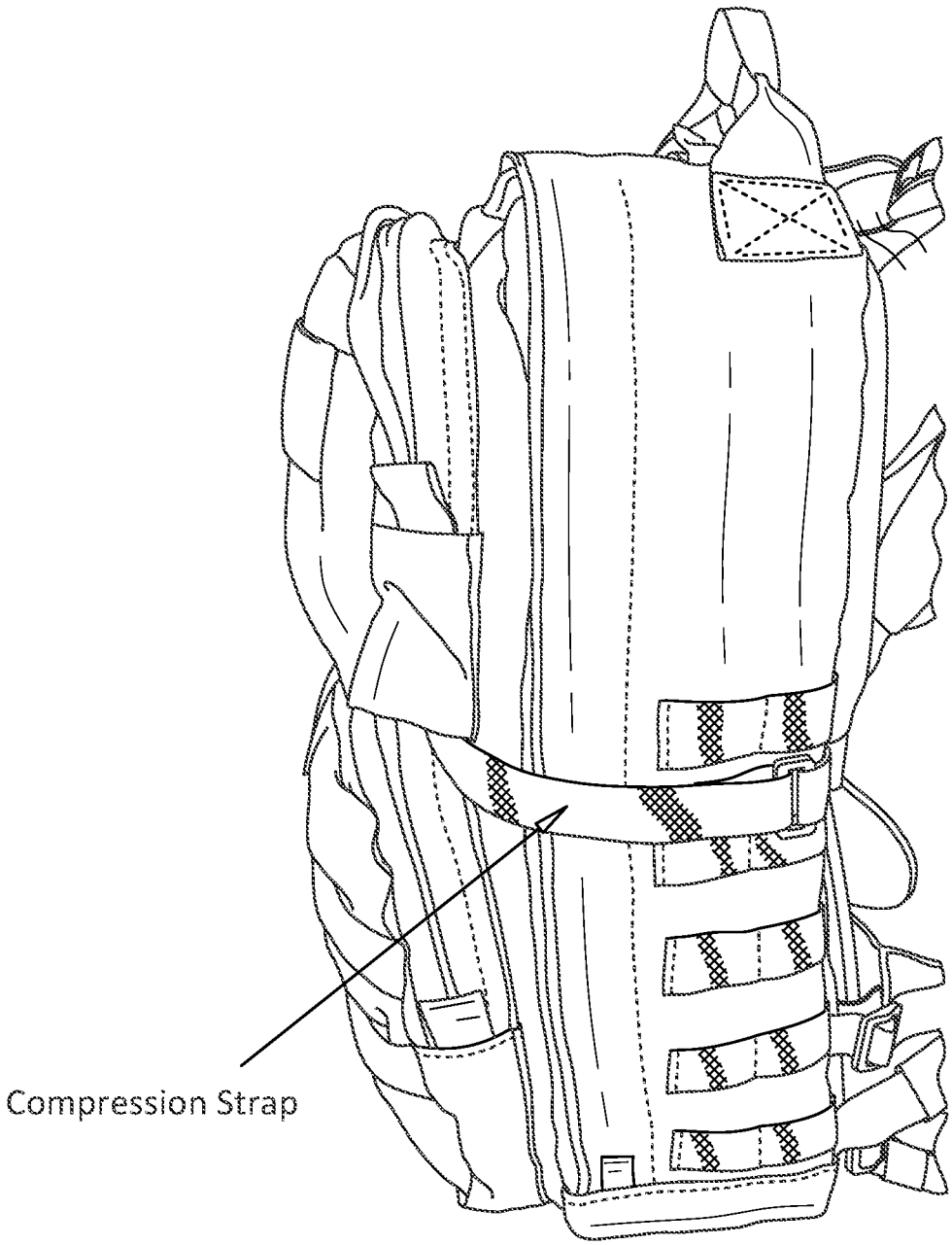

FIG. 5B generally shows the preferred frame mounting configuration. In FIG. 5B, a horizontal mount strap 508 spans the entire width of ruck's back panel with a horizontal adjuster(s) 516 at each end to allow the horizontal mount strap 508 to thread through the scapula slots, under a horizontal strap loop (one on either side) as shown in FIG. 5C and tensioned. A vertical mounting strap 512 anchored to the paned shared with nick's upper receiving pockets (for the frame) is passed under a vertical strap loop 510 and tensioned by a vertical adjuster 514. FIG. 5D details this arrangement without the frame in place; it should be noted that the vertical mounting strap 512 is passed under a vertical strap loop 520 and the horizontal mounting strap 508 is passed under horizontal strap loops 522, where the loops are sewn to the ruck's back panel. FIGS. 5E and 5F detail the compression strap's preferred embodiment; by locating its anchor points on the same lateral plane as the horizontal mounting strap, stability imparted by the frame when the ruck's contents are compressed against the frame by the tensioned compression strap is maximized.

Figure 4:
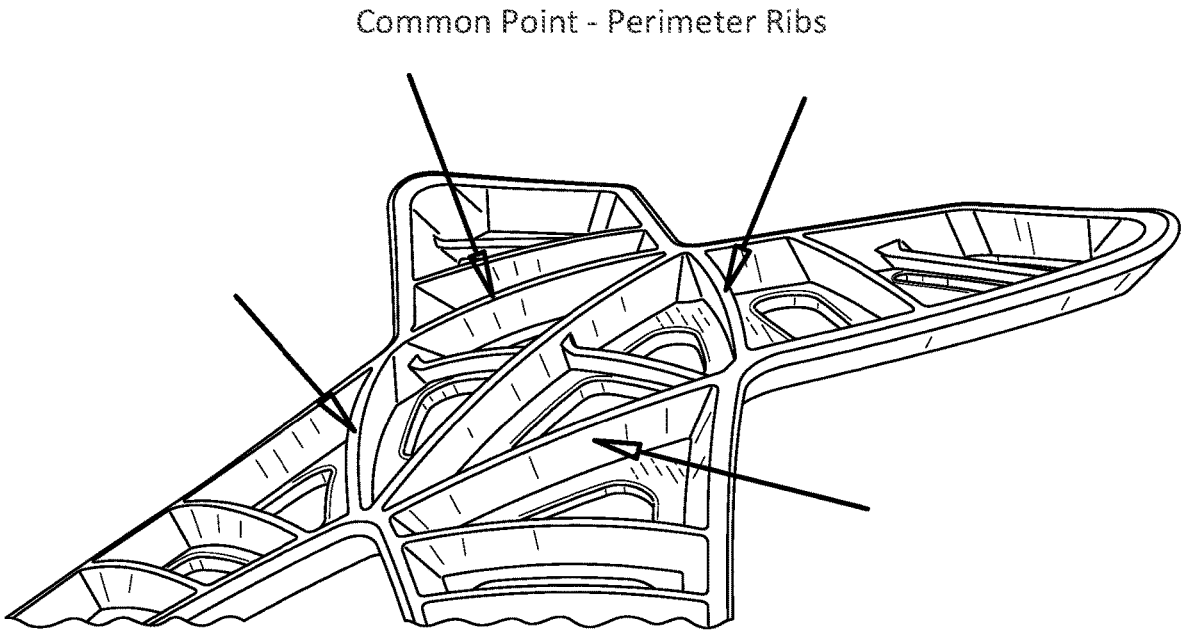
FIG. 4 depicts one embodiment of the present invention, where the backside of the frame's common point has a set of perimeter ribs.
Figure 6:
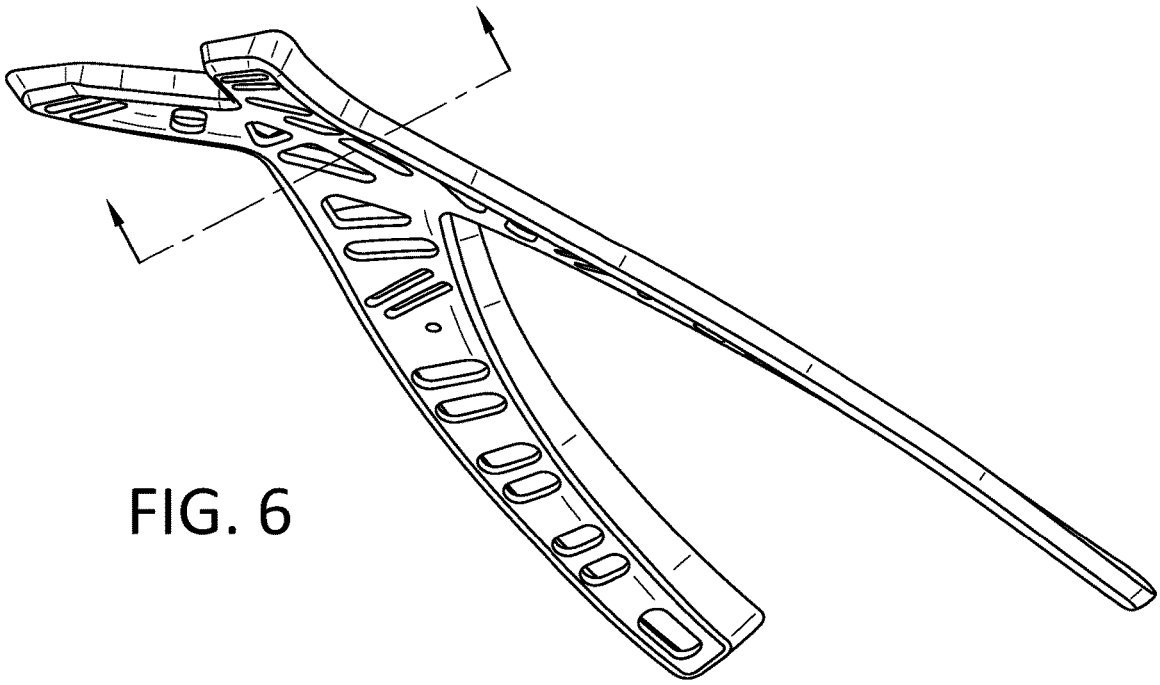
FIG. 6 depicts the present invention's frame with an axis for a cross section of interest.
Figure 7:
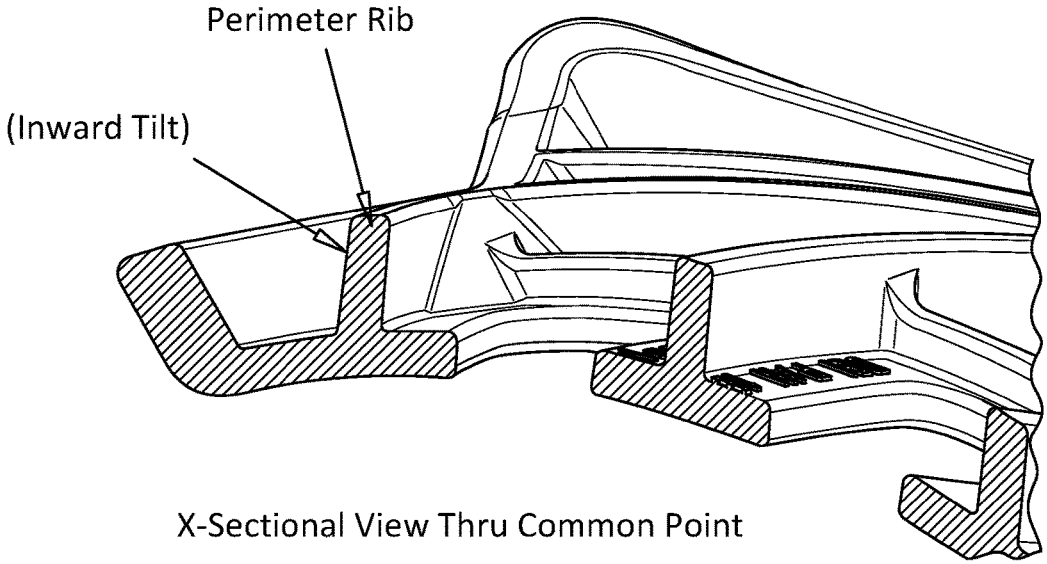
FIG. 7 shows the cross section of interest showing the inward tilt of the perimeter ribs.

FIG. 4 depicts one embodiment of the present invention, where the backside of the frame's common point has a set of perimeter ribs, where the common point's perimeter ribs are located at the upper and lower support member/common point intersections and the perimeter ribs tilt inward toward the common point's center. This maximizes the distribution of stresses imparted by the members as they are flexed away from the wearer's back and toward the convex side of the frame as the nick is carried. These ribs together create a closed, mutually reinforcing structure that encircles the common point. Should a cross-section be taken of the common point as shown in FIG. 6, the inward tilt can be seen. Such a cross-section is depicted in FIG. 7 which shows the inward tilt of the perimeter ribs.

Conclusion

A system and method has been shown in the above embodiments for the effective implementation of a compound arc pack and frame. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, materials, or specific manufacturing techniques.

The invention claimed is:

1. A backpack frame for use with a backpack, the backpack frame having a backpack frame front side, a backpack frame back side and a central axis, the backpack having a backpack back side that retains the backpack frame, the backpack frame comprising:

(a) a common point;

(b) a first upper vertical support member and a second upper vertical support member, the first and second upper vertical support members ascending from the common point, wherein the first and second upper vertical support members are mirrored images of each other and are separated from each other equidistantly with respect to the central axis;

(c) a first lower vertical support member descending from the common point and longitudinally concave relative to the backpack back side;

(d) a second lower vertical support member also descending from the common point and also longitudinally concave relative to the backpack back side, and wherein the first upper vertical support member, the second upper vertical support member, the first lower vertical support member, the second lower vertical support member, and the common point form a continuous X-shaped structure;

(e) four perimeter ribs forming, on a backside of the common point, a closed, mutually reinforcing structure around the common point, the four perimeter ribs located at intersections of each of the first lower vertical support member, the second lower vertical support member, the first upper vertical support member, the second upper vertical support member and the common point;

wherein the first lower vertical support member and the second lower vertical support member are mirror images of each other and are separated from each other equidistantly with respect to the central axis, wherein the first lower vertical support member having a twist in a first direction to form a latitudinal concavity relative to the backpack back side and the second lower vertical support member having another twist or a cant in a second direction to form another longitudinal concavity relative to the backpack back side, the second direction opposite to the first direction, and wherein a center of the common point is picked to be located between 20%-30% of an overall frame length of the backpack frame below a top of the backpack frame.

2. The backpack frame of claim 1, wherein the backpack back side having a pair of lower receiving pockets disposed at a bottom side of the backpack back side and a pair of upper receiving pockets disposed at a top side of the backpack back side, wherein each free end of the first and second upper vertical support members configured to rest in the upper receiving pockets, and wherein each free end of the first and second lower vertical support members configured to rest in the lower receiving pockets.

3. The backpack frame of claim 2, wherein a vertical tensioning web and an adjuster directly cinch each of the pairs of upper and lower receiving pockets toward each other.

4. The backpack frame of claim 2, wherein the lower receiving pockets are disposed behind a waistbelt of the backpack.

5. The backpack frame of claim 2, wherein the lower receiving pockets are disposed on a waistbelt of the backpack.

6. The backpack frame of claim 2, wherein the upper receiving pockets and the lower receiving pockets are made from any of the following materials: fabric and foam sheets.

7. The backpack frame of claim 1, wherein the four perimeter ribs tilt inward toward a center of the common point.

8. The backpack frame of claim 1, wherein the first lower vertical support member and the second lower vertical support member each have a left scapula slot and a right scapula slot.

9. The backpack frame of claim 8, wherein a horizontal mounting strap anchored on the backpack back side is threaded out through each of the left and right scapula slots in the first lower vertical support member and through each of the left and right scapula slots in the second lower vertical support member, and further under a web loop sewn on the backpack back side.

10. The backpack frame of claim 1, wherein the frame is made from injection molded thermoplastics.

11. The backpack frame of claim 1, wherein the twist is longitudinally and continuously canted at an angle picked from the following range: 5-45 degrees.

12. An apparatus comprising:

(a) a backpack having a backpack back side and a backpack front side, the backpack back side having a pair of lower receiving pockets disposed at a bottom side of the backpack back side and a pair of upper receiving pockets disposed at a top side of the backpack back side;

(b) a backpack frame for use with the backpack, the backpack frame having a backpack frame front side, a backpack frame back side and a central axis, the backpack back side retaining the backpack frame, the backpack frame comprising:

(1) a common point;

(2) a first upper vertical support member and a second upper vertical support member, the first and second upper vertical support members ascending from the common point, wherein the first and second upper vertical support members are mirrored images of each other and are separated from each other equidistantly with respect to the central axis;

(3) a first lower vertical support member having a first lower vertical support member free end, the first lower vertical support member descending from the common point and longitudinally concave relative to the backpack back side, the first lower vertical support member free end configured to rest in one of the lower receiving pockets;

(4) a second lower vertical support member having a second lower vertical support member free end, the second lower vertical support member also descending from the common point and also longitudinally concave relative to the backpack back side, the second lower vertical support member free end configured to rest in another one of the lower receiving pockets, and wherein the first upper vertical support member, the second upper vertical support member, the first lower vertical support member, the second lower vertical support member, and the common point form a continuous X-shaped structure;

(5) four perimeter ribs forming, on a backside of the common point, a closed, mutually reinforcing structure around the common point, the four perimeter ribs located at intersections of each of the first lower vertical support member, the second lower vertical support member, the first upper vertical support member, the second upper vertical support member and the common point, wherein the four perimeter ribs tilt inward toward a center of the common point;

wherein the first lower vertical support member and second lower support member are mirror images of each other and are separated from each other equidistantly with respect to the central axis, wherein the first lower vertical support member having a twist in a first direction to form a latitudinal concavity relative to the backpack back side and the second lower vertical support member having another twist or a cant in a second direction to form another longitudinal concavity relative to the backpack back side, the second direction opposite to the first direction, and wherein a center of the common point is picked to be located between 20%-30% of an overall frame length of the backpack frame below a top of the backpack frame.

13. The apparatus of claim 12, wherein a vertical tensioning web and an adjuster directly cinch each of the pairs of upper and lower receiving pockets toward each other.

14. The apparatus of claim 12, wherein the lower receiving pockets are disposed behind a waistbelt of the backpack.

15. The apparatus of claim 12, wherein the lower receiving pockets are disposed on a waistbelt of the backpack.

16. The apparatus of claim 12, wherein the first lower vertical support member and the second lower vertical support member each have a left scapula slot and a right scapula slot.

17. The apparatus of claim 16, wherein a horizontal mounting strap anchored on the backpack back side is threaded out through each of the left and right scapula slots in the first lower vertical support member and through each of the left and right scapula slots in the second lower vertical support member, and further under a web loop sewn on the backpack back side.

18. The apparatus of claim 12, wherein the upper receiving pockets and the lower receiving pockets are made from any of the following materials: fabric and foam sheets.

19. The apparatus of claim 12, wherein the backpack frame is made from injection molded thermoplastics.

20. The apparatus of claim 12, wherein the twist is longitudinally and continuously canted at an angle picked from the following range: 5-45 degrees.

* * * * *